US007526933B2

(12) United States Patent
Meekma

(10) Patent No.: US 7,526,933 B2
(45) Date of Patent: May 5, 2009

(54) MULTIPOINT DOOR LOCK

(75) Inventor: Glenn P. Meekma, Menomonee Falls, WI (US)

(73) Assignee: Master Lock Company LLC, Oak Creek, WI (US)

( * ) Notice: Subject to any disclaimer, the term of this patent is extended or adjusted under 35 U.S.C. 154(b) by 190 days.

(21) Appl. No.: 11/703,453

(22) Filed: Feb. 7, 2007

(65) Prior Publication Data

US 2008/0092606 A1 Apr. 24, 2008

Related U.S. Application Data

(60) Provisional application No. 60/852,495, filed on Oct. 18, 2006.

(51) Int. Cl.
*E05B 63/14* (2006.01)

(52) U.S. Cl. ..... 70/120; 70/118; 292/39

(58) Field of Classification Search ..... 70/107, 70/113–116, 118–121, 123; 292/3, 5, 8, 292/37, 39, 47, 49, 98, 111, 140
See application file for complete search history.

(56) References Cited

U.S. PATENT DOCUMENTS

| | | | |
|---|---|---|---|
| 1,277,174 | A | 8/1918 | Bakst |
| 1,341,038 | A | 5/1920 | Bickel |
| 1,908,980 | A | 5/1933 | Heyel |
| 1,959,361 | A | 5/1934 | Holtzman |
| 2,059,046 | A | 10/1936 | Singer et al. |
| 2,125,227 | A | 7/1938 | Hammarle |
| 2,390,731 | A | 12/1945 | Oxhandler |
| 2,494,575 | A | 1/1950 | O'Brien |
| 2,584,088 | A | 1/1952 | Floyd |
| 2,946,214 | A | 7/1960 | Gotay |
| 2,969,666 | A | 1/1961 | Muessel |
| 2,989,859 | A | 6/1961 | Eads |
| 3,245,237 | A | 4/1966 | Eads et al. |
| 3,582,119 | A | 6/1971 | Woodworth |

(Continued)

FOREIGN PATENT DOCUMENTS

| | | |
|---|---|---|
| AU | 9540311 | 11/1995 |

(Continued)

OTHER PUBLICATIONS

International Search Report and Written Opinion from International Application No. PCT/US2007/79267, mailed Sep. 10, 2008.

*Primary Examiner*—Suzanne D Barrett
(74) *Attorney, Agent, or Firm*—Calfee, Halter & Griswold LLP

(57) ABSTRACT

A lock assembly that secures a door to an adjacent frame. The assembly includes an elongated base, a cam assembly mounted to the base including a housing, a lever, and a sliding member having a first end slidably connected to the lever and movable in a direction perpendicular to the base by rotation of the lever, an extension actuator having a proximal end movably connected to a second end of the sliding member, and a lock mechanism mounted to the elongated base and movable between unlocked and locked positions. The second end of the sliding member extends to a position within the housing upon full rotation of the lever. The extension actuator and base may permit modular addition of lock mechanisms at multiple locations.

27 Claims, 12 Drawing Sheets

U.S. PATENT DOCUMENTS

| | | | |
|---|---|---|---|
| 3,633,389 | A | 1/1972 | Horgan |
| 3,751,949 | A | 8/1973 | Castle |
| 3,834,747 | A | 9/1974 | Slovensky, Jr. |
| 3,863,471 | A | 2/1975 | Keller-Volper |
| 3,910,611 | A | 10/1975 | Slovensky, Jr. |
| 3,965,707 | A | 6/1976 | Byars et al. |
| 3,975,934 | A | 8/1976 | Babai et al. |
| 3,990,278 | A | 11/1976 | Perelson |
| 3,991,595 | A | 11/1976 | Bahry et al. |
| 4,127,995 | A | 12/1978 | Miller |
| 4,184,349 | A | 1/1980 | Zaks |
| 4,192,535 | A | 3/1980 | Picard |
| 4,233,913 | A | 11/1980 | Herrmann |
| 4,237,709 | A | 12/1980 | Krugener et al. |
| 4,237,710 | A | 12/1980 | Cardozo |
| 4,306,432 | A | 12/1981 | Ravid |
| 4,391,460 | A | 7/1983 | Bonet |
| 4,470,277 | A | 9/1984 | Uyeda |
| 4,476,700 | A | 10/1984 | King |
| 4,534,192 | A | 8/1985 | Harshbarger et al. |
| 4,639,021 | A | 1/1987 | Hope |
| 4,643,005 | A | 2/1987 | Logas |
| 4,704,880 | A | 11/1987 | Schlindwein |
| 4,892,338 | A | 1/1990 | Weinerman et al. |
| 4,984,832 | A | 1/1991 | Canepa |
| 5,083,822 | A | 1/1992 | Mangin et al. |
| 5,096,237 | A | 3/1992 | Hotzl |
| 5,265,920 | A | 11/1993 | Kaup et al. |
| 5,290,077 | A | 3/1994 | Fleming |
| 5,373,716 | A | 12/1994 | MacNeil et al. |
| 5,388,875 | A | 2/1995 | Fleming |
| 5,472,247 | A | 12/1995 | Monson |
| 5,495,731 | A | 3/1996 | Riznik |
| 5,498,038 | A | 3/1996 | Simon et al. |
| 5,524,941 | A | 6/1996 | Fleming |
| 5,524,942 | A | 6/1996 | Fleming |
| 5,542,720 | A | 8/1996 | Fleming |
| 5,561,994 | A | 10/1996 | Smith et al. |
| 5,603,534 | A | 2/1997 | Fuller |
| 5,620,216 | A | 4/1997 | Fuller |
| 5,697,654 | A | 12/1997 | MacDonald |
| 5,709,111 | A | 1/1998 | Henao |
| 5,782,114 | A | 7/1998 | Zeus et al. |
| 5,791,700 | A | 8/1998 | Biro |
| 5,794,467 | A | 8/1998 | Justice |
| 5,806,353 | A | 9/1998 | Pages |
| 5,820,170 | A | 10/1998 | Clancy |
| 5,865,479 | A | 2/1999 | Viney |
| 5,878,606 | A | 3/1999 | Chaput et al. |
| 5,890,753 | A | 4/1999 | Fuller |
| 5,901,989 | A | 5/1999 | Becken et al. |
| 5,906,403 | A | 5/1999 | Bestler et al. |
| 5,911,763 | A | 6/1999 | Quesada |
| 5,938,248 | A | 8/1999 | Vickers et al. |
| 5,975,592 | A | 11/1999 | Lin |
| 5,992,188 | A | 11/1999 | Saunders |
| 6,086,121 | A | 7/2000 | Buckland |
| 6,152,497 | A | 11/2000 | Vickers et al. |
| 6,209,364 | B1 | 4/2001 | Collet et al. |
| 6,217,087 | B1 | 4/2001 | Fuller |
| 6,250,119 | B1 | 6/2001 | Flon |
| 6,257,030 | B1 | 7/2001 | Davis, III et al. |
| 6,264,252 | B1 | 7/2001 | Clancy |
| 6,270,129 | B1 | 8/2001 | Prevot et al. |
| 6,282,929 | B1 | 9/2001 | Eller et al. |
| 6,289,704 | B1 | 9/2001 | Collet et al. |
| 6,324,876 | B1 | 12/2001 | Prevot et al. |
| 6,375,244 | B1 | 4/2002 | Smeltzer |
| 6,378,916 | B1 | 4/2002 | Huang |
| 6,478,345 | B1 | 11/2002 | Viney |
| 6,637,784 | B1 | 10/2003 | Hauber et al. |
| 6,641,182 | B2 | 11/2003 | Schlack et al. |
| 6,688,656 | B1 | 2/2004 | Becken |
| 6,698,970 | B2 | 3/2004 | Guillemet et al. |
| 6,871,451 | B2 | 3/2005 | Harger et al. |
| 6,907,830 | B2 | 6/2005 | Guinan et al. |
| 6,935,662 | B1 | 8/2005 | Hauber et al. |
| 6,971,686 | B2 | 12/2005 | Becken |
| 6,981,724 | B2 | 1/2006 | Denys |
| 7,013,688 | B2 | 3/2006 | Chen |
| 7,025,394 | B1 | 4/2006 | Hunt |
| 2002/0104339 | A1 | 8/2002 | Saner |
| 2003/0159478 | A1 | 8/2003 | Nagy |
| 2003/0226384 | A1 | 12/2003 | Shedd et al. |
| 2005/0092042 | A1 | 5/2005 | Constantinou et al. |
| 2005/0103066 | A1 | 5/2005 | Botha et al. |
| 2005/0166647 | A1 | 8/2005 | Walls et al. |
| 2005/0229657 | A1 | 10/2005 | Johansson et al. |
| 2006/0028027 | A1 | 2/2006 | Schlack et al. |
| 2006/0071478 | A1 | 4/2006 | Denys |

FOREIGN PATENT DOCUMENTS

| | | | |
|---|---|---|---|
| AU | 9710093 | | 1/1996 |
| AU | 9877494 | | 7/1998 |
| AU | 9877495 | | 7/1998 |
| AU | 9914734 | | 2/1999 |
| AU | 200019439 | A1 | 6/2000 |
| CA | 2221223 | | 11/1998 |
| CA | 2326478 | | 11/2000 |
| CH | 691983 | | 12/2001 |
| CH | 692627 | | 8/2002 |
| DE | 2632927 | | 4/1978 |
| DE | 3008043 | A1 | 10/1981 |
| DE | 3432981 | A1 | 3/1986 |
| DE | 3920498 | | 2/1990 |
| DE | 3836694 | | 5/1990 |
| DE | 2961563 | U1 | 3/1997 |
| DE | 19628010 | | 1/1998 |
| DE | 19628011 | | 1/1998 |
| DE | 19628012 | | 1/1998 |
| DE | 19931735 | | 1/2001 |
| DE | 29916887 | U1 | 3/2001 |
| DE | 20203565 | U1 | 6/2002 |
| DE | 10202008 | | 7/2002 |
| DE | 10122466 | | 11/2002 |
| DE | 10310085 | | 9/2004 |
| DE | 2005000938 | U1 | 6/2005 |
| DE | 2005000939 | U1 | 6/2005 |
| EP | 0413177 | | 2/1991 |
| EP | 0661409 | A2 | 7/1995 |
| EP | 0725198 | | 8/1996 |
| EP | 0924373 | | 6/1999 |
| EP | 0943768 | | 9/1999 |
| EP | 0972900 | | 1/2000 |
| EP | 0995865 | | 4/2000 |
| EP | 0995866 | | 4/2000 |
| EP | 1057957 | | 12/2000 |
| EP | 1087084 | | 3/2001 |
| EP | 1106761 | A1 | 6/2001 |
| EP | 1154102 | A2 | 11/2001 |
| EP | 1167661 | | 1/2002 |
| EP | 1340872 | | 9/2003 |
| EP | 1431481 | | 6/2004 |
| EP | 1452674 | | 9/2004 |
| EP | 1452675 | | 9/2004 |
| EP | 1473424 | | 11/2004 |
| EP | 1544390 | | 6/2005 |
| EP | 1557514 | | 7/2005 |
| EP | 1574644 | | 9/2005 |
| FR | 2298664 | | 8/1976 |
| FR | 2319760 | | 2/1977 |
| FR | 2451441 | | 10/1980 |
| FR | 2457365 | | 12/1980 |

| | | | |
|---|---|---|---|
| FR | 2488318 | | 2/1982 |
| FR | 2550265 | | 2/1985 |
| FR | 2551126 | | 3/1985 |
| FR | 2841584 | | 1/2002 |
| FR | 2858348 | | 2/2005 |
| FR | 2877383 | | 5/2006 |
| GB | 2119014 | | 11/1983 |
| GB | 2168105 | | 6/1986 |
| GB | 2196375 | | 4/1988 |
| GB | 2196382 | A | 4/1988 |
| GB | 2242702 | A | 10/1991 |
| GB | 2268221 | | 1/1994 |
| GB | 2270343 | | 3/1994 |
| GB | 2299612 | | 10/1996 |
| GB | 2325694 | | 12/1998 |
| GB | 2416188 | | 1/2006 |
| JP | 11006349 | | 1/1999 |
| JP | 11006350 | | 1/1999 |
| JP | 11006350 | A | 1/1999 |
| JP | 11006351 | | 1/1999 |
| JP | 11013323 | | 1/1999 |
| JP | 11044137 | | 2/1999 |
| JP | 11190162 | | 7/1999 |
| JP | 11200694 | A | 7/1999 |
| JP | 11223061 | A | 8/1999 |
| JP | 2000186447 | A | 7/2000 |
| JP | 2000291303 | A | 10/2000 |
| JP | 2001055855 | A | 2/2001 |
| JP | 2001082012 | A | 3/2001 |
| JP | 2001146865 | A | 5/2001 |
| JP | 2001227213 | | 8/2001 |
| JP | 2001254551 | | 9/2001 |
| JP | 2003019330 | A | 1/2003 |
| JP | 2003307067 | A | 10/2003 |
| JP | 2003328619 | A | 11/2003 |
| JP | 2004036293 | A | 2/2004 |
| JP | 2004068491 | | 3/2004 |
| JP | 2004169384 | | 6/2004 |
| JP | 2004204611 | A | 7/2004 |
| JP | 2004308309 | A | 11/2004 |
| JP | 2005350974 | A | 12/2005 |
| JP | 2006077475 | | 3/2006 |
| JP | 2006097359 | | 4/2006 |
| JP | 2006097360 | | 4/2006 |
| JP | 2006097361 | | 4/2006 |
| JP | 2006125058 | A | 5/2006 |
| JP | 2006125128 | | 5/2006 |
| JP | 2006089986 | A | 4/2007 |
| NZ | 502886 | | 5/2000 |
| WO | WO 01/79633 | A1 | 10/2001 |
| WO | WO 03/078767 | A1 | 9/2003 |
| WO | WO 03/095774 | A1 | 11/2003 |
| WO | WO 2004/059114 | A1 | 7/2004 |
| WO | WO 2005/038175 | A1 | 4/2005 |

MULTIPOINT DOOR LOCK

CROSS REFERENCE TO RELATED APPLICATIONS

This non-provisional application claims the benefit of U.S. Provisional Patent Application No. 60/852,495, entitled "Multipoint Door Lock" and filed Oct. 18, 2006, the entire disclosure of which is hereby incorporated by reference, to the extent that it is not conflicting with this application.

FIELD OF THE INVENTION

The present invention relates to a lock system having mechanisms that secure the door at multiple locations.

BACKGROUND OF THE INVENTION

A variety of door locks are known in the art that include an engaging mechanism between the door and an adjacent surface, such as a door jam or an opposing twin door. The mechanisms are typically mounted within the door and include a latching arm that latches into an opening in a door jam or adjacent surface when the door is closed. In addition to the latching arm, the locks may include a deadbolt or a spring loaded latch that is operated by user manipulation of a door knob. A problem exits with these prior art systems in that the center of the door where the deadbolt is located bears a disproportionate load from a locking standpoint, thus creating a weak point that may be easily compromised from a security standpoint.

There remains a need in the art for a multiple point lock system having increased strength, ease of use, and a reliable mechanical design that is adaptable to a variety of door handle styles and classes.

SUMMARY OF THE INVENTION

In several illustrated embodiments of the present invention, a multipoint lock and locking system is disclosed. The locking system may include a combination of a cam system operated by a cylinder lock, a spring loaded latch mechanism, a vertical shoot bolt, and a slide hook. The system secures the door to one or more objects at multiple locations.

Further features and advantages of the invention will become apparent from the following detailed description made with reference to the accompanying drawings.

DETAILED DESCRIPTION OF THE INVENTION

This Detailed Description of the Invention merely describes embodiments of the invention and is not intended to limit the scope of the claims in any way. Indeed, the invention as described is broader than and unlimited by the preferred embodiments, and the terms used have their full ordinary meaning.

An embodiment of the invention shown is a multipoint door locking system that engages and locks the door to the door jam in multiple areas along the length or width of the door using a variety of engagement methods. This system is adapted to a variety of door hardware classes, such as for example, American style door handle set hardware.

The present invention will be described for use with an exemplary single door mounted in a conventional door jam. Various assemblies of the system are linked by extension pieces that translate up and down motion between assemblies in a vertical plane. The door includes a user operated lock cylinder and a rotating doorknob or handle set. It should be understood that this application is for exemplary purposes only and the invention can be applied to a wide variety of applications.

The locking mechanism made in accordance with this invention may include a variety of specific locking mechanisms. It should be understood that such mechanisms, such as for example, shoot bolt assemblies and slide hook assemblies, may be installed at various locations and in various amounts in the practice of this invention. In an embodiment, the locking assembly includes an assembly of extension actuators and links, and a door style base that permits modular addition of various lock mechanisms at multiple locations. As a result, an installer can include any number of combination of locking mechanisms depending on the safety, cost, jurisdictional code or geometric requirements of the installation site.

Figure 1:
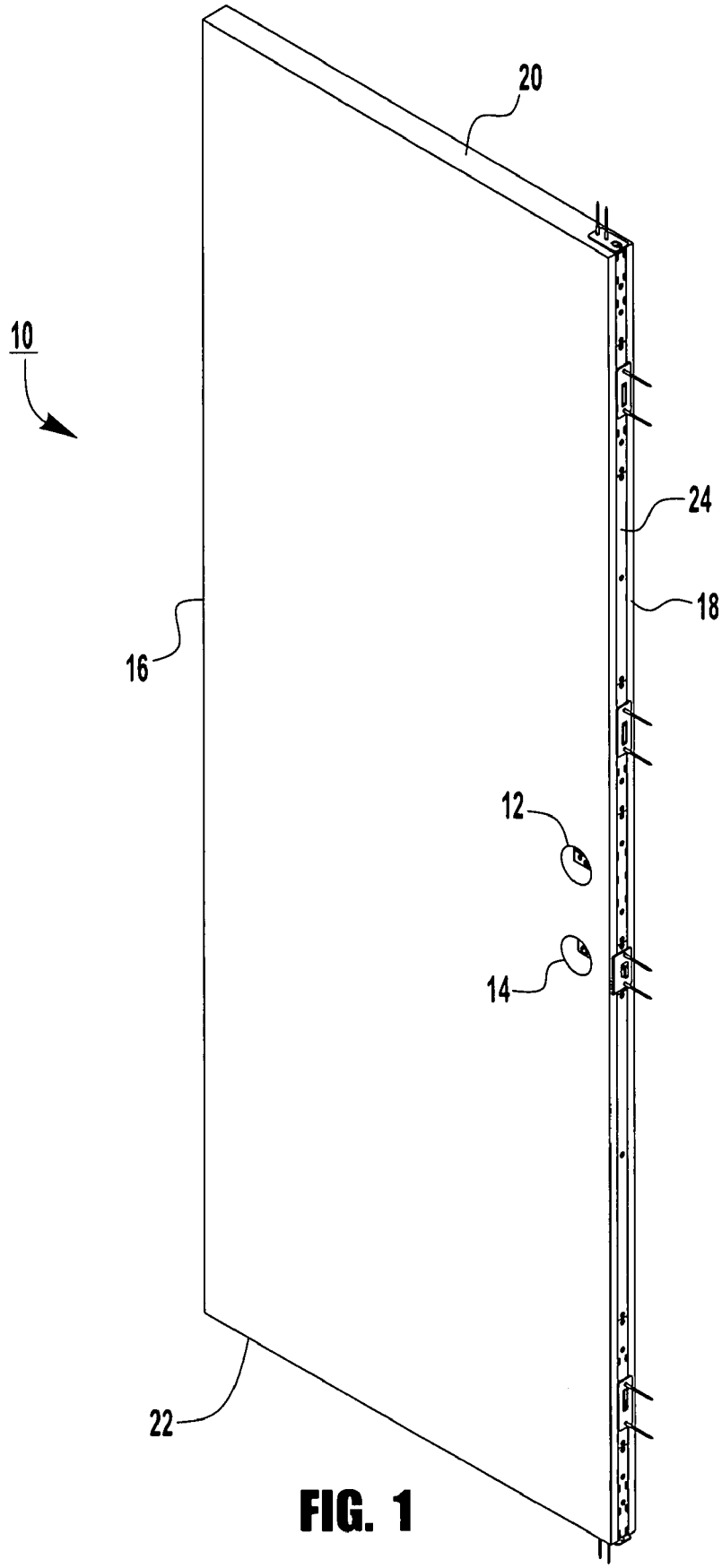
FIG. 1 is a perspective view of a door having a multipoint locking assembly made in accordance with an embodiment of the present invention.

Referring now to the drawings, FIG. 1 is a perspective view of a door 10 that includes a locking assembly 24. The door 10 includes a first cutout 12 for installation of a lock cylinder (not shown) and a second cutout 14 for installation of a door knob or handle set (not shown). For exemplary purposes only, the door 10 is shown from the outside in FIG. 1 and any locking cylinder is operable by a user at least from the opposing side. As shown, the left edge 16 of the door may include hinges (not shown) for mounting to a door frame. In the front or right edge 18 of the door, a locking assembly 24 is shown. It should be understood in the practice of the invention, that the locking assembly may include any number or type of locking mechanisms installed at a variety of locations on the door. The door 10 further includes a top edge 20 and a bottom edge 22. As shown, the locking assembly 24 is a multipoint locking assembly and extends from the top edge 20 to the bottom edge 22.

Figure 2:
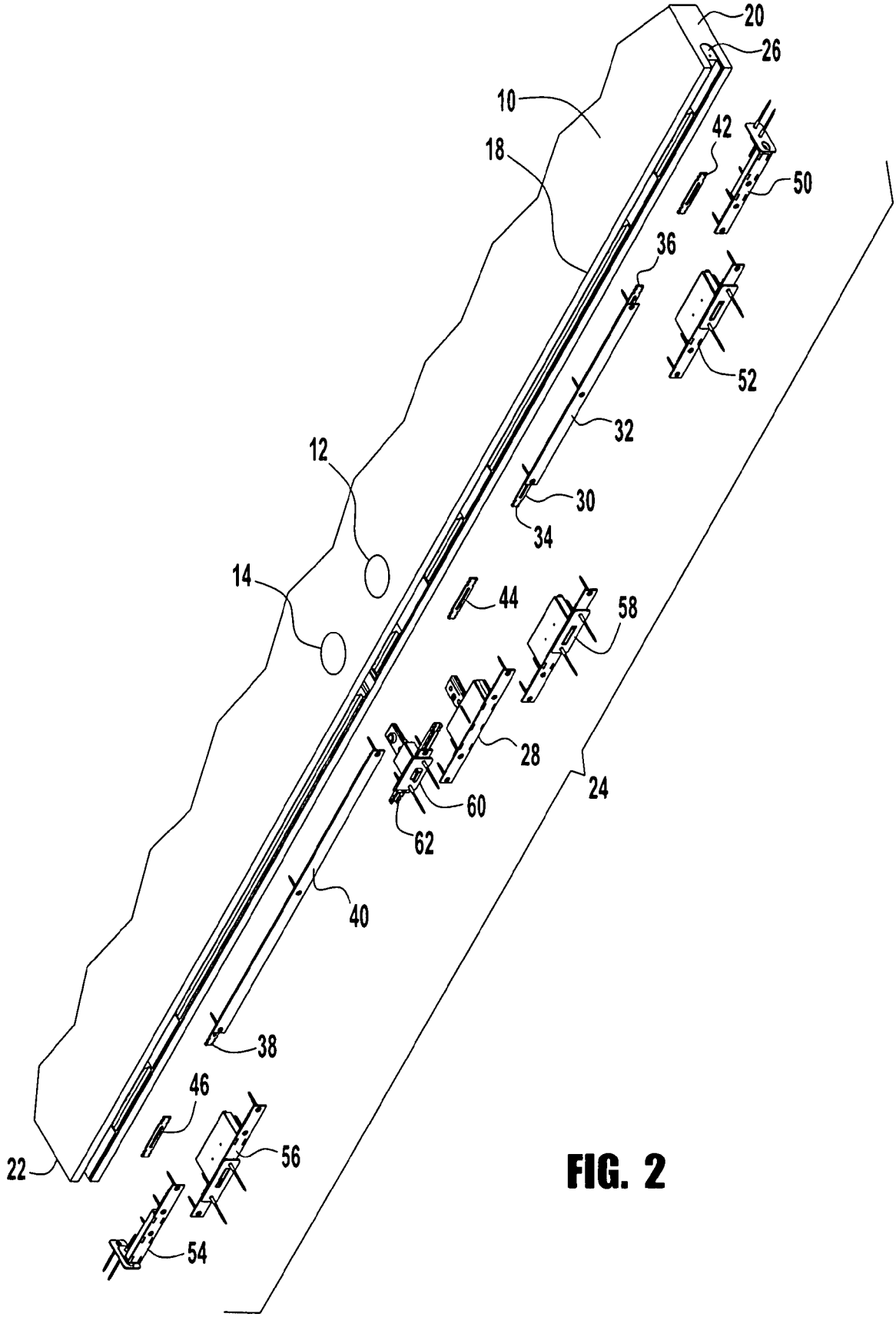
FIG. 2 is an exploded perspective view of the multipoint locking device of FIG. 1.

An exploded perspective view of the multipoint locking device 24 is shown in FIG. 2. An elongated base or door style 26 is mounted within the front edge 18 of the door 10. As shown, the door style 26 runs the height of the door but any length door style may be used in the practice of this invention, The device 24 further includes a plurality of locking mechanisms of different types and installed at various locations along the top edge 20, front edge 18, and bottom edge 22 of the door 10. The locking mechanism are in mechanical communication through a series of extension actuators and actuator links. In the embodiments shown, the extension and links have parallel longitudinal axes and are driven in opposing directions $A_1$, $A_2$ (see FIG. 3) by motion of a cam assembly 28, to be discussed in more detail.

An upper extension actuator 30 is disposed adjacent and parallel to the door style 26 by a cover plate 32 and a set of hardware. A long center aperture allows the extension actuator to move up and down relative to the fixed door style 26 and cover plate 32. The extension actuator has opposing ends 34, 36 with a series of notches for mechanical connection to other free moving parts, such as for example, other members or links within locking mechanisms. In the embodiment shown, a lower extension actuator 38 is disposed adjacent and parallel to the door style 26 by a cover plate 40 and a set of hardware. Similarly, a long center aperture allows the lower extension actuator 38 to move up and down relative to the fixed door style 26 and cover plate 32. As mentioned, the locking assembly 24 includes three actuator links 42, 44, 46. Two actuator links 42, 46 provide a mechanical connection between various locking mechanisms. The upper actuator link 42 connects an upper shoot bolt assembly 50 with a first upper slide hook assembly 52, while the lower actuator link 46 connects a lower shoot bolt assembly 54 with a lower slide hook assembly 56. The actuator link 44 connects the cam assembly 28 with a second upper slide hook assembly 58. The connections between components of the multipoint locking device 24 are completed by the extension actuators 34, 38 as shown. A latch assembly 60 is also included between the cam assembly 28 and lower extension actuator 38. A link member 62 is disposed in the latch but moves freely in directions $A_1$, $A_2$ relative to the door style 26. Movement of the latch assembly by manual operation of a door handle does not effect any movement of the multipoint locking device 24. This configuration omits a dead bolt to reduce the load relative to locking in the center of the door should someone attempt to compromise the locking system by applying force to the door.

Figure 3:
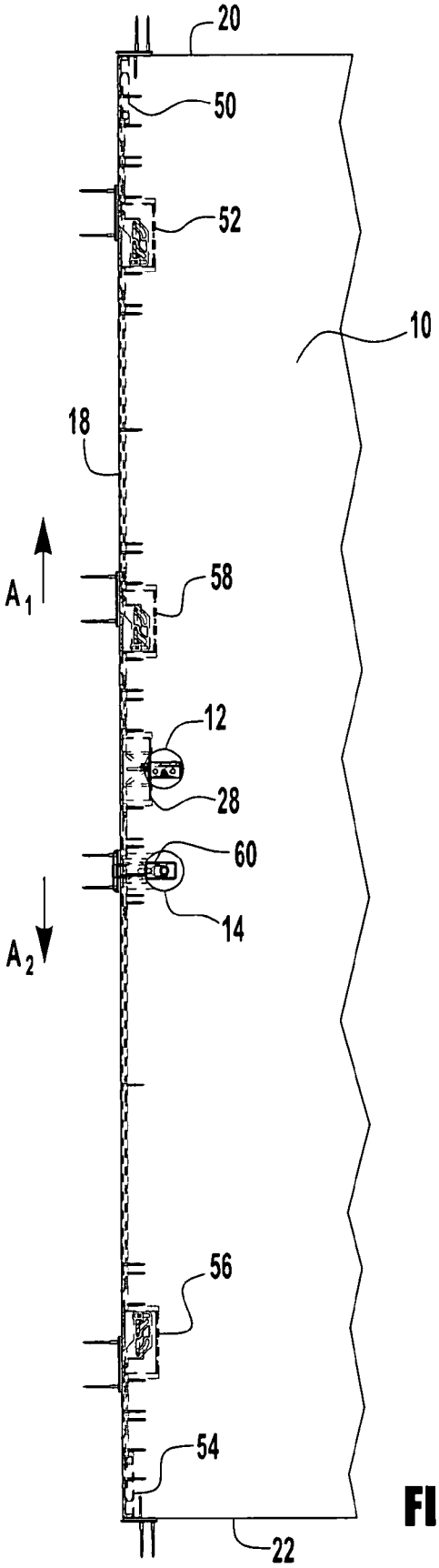
FIG. 3 is a front view of a portion of the door of FIG. 1, showing the multipoint locking assembly in an unlocked position.
Figure 4:
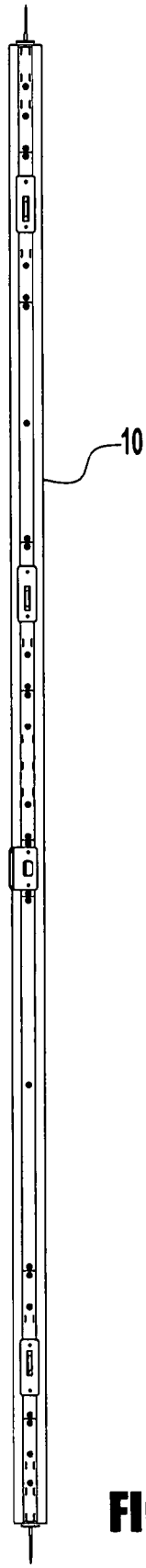
FIG. 4 is a side view of the door of FIG. 1.

Relative to FIGS. 1 and 2, an inside portion of the door 10 is shown in FIG. 3. The multipoint locking device 24 is illustrated in an unlocked position. FIG. 4 is a side view of the door 10 in the same position. As shown in FIGS. 3-4, no portion of any locking mechanism 50, 52, 54, 56, 58 is shown in an extending position beyond the top edge 20, front edge 18 or bottom edge 22 of the door 10. Each individual locking mechanism 50, 52, 54, 56, 58 is operable between the unlocked, or retracted position, and a locked, or extended position, by user manipulation of the cam assembly 28. It should be appreciated that the cam assembly can be manipulated by various means, such as for example, a manual lever, a key, a combination lock, RF technology or any other suitable means.

Figure 5:
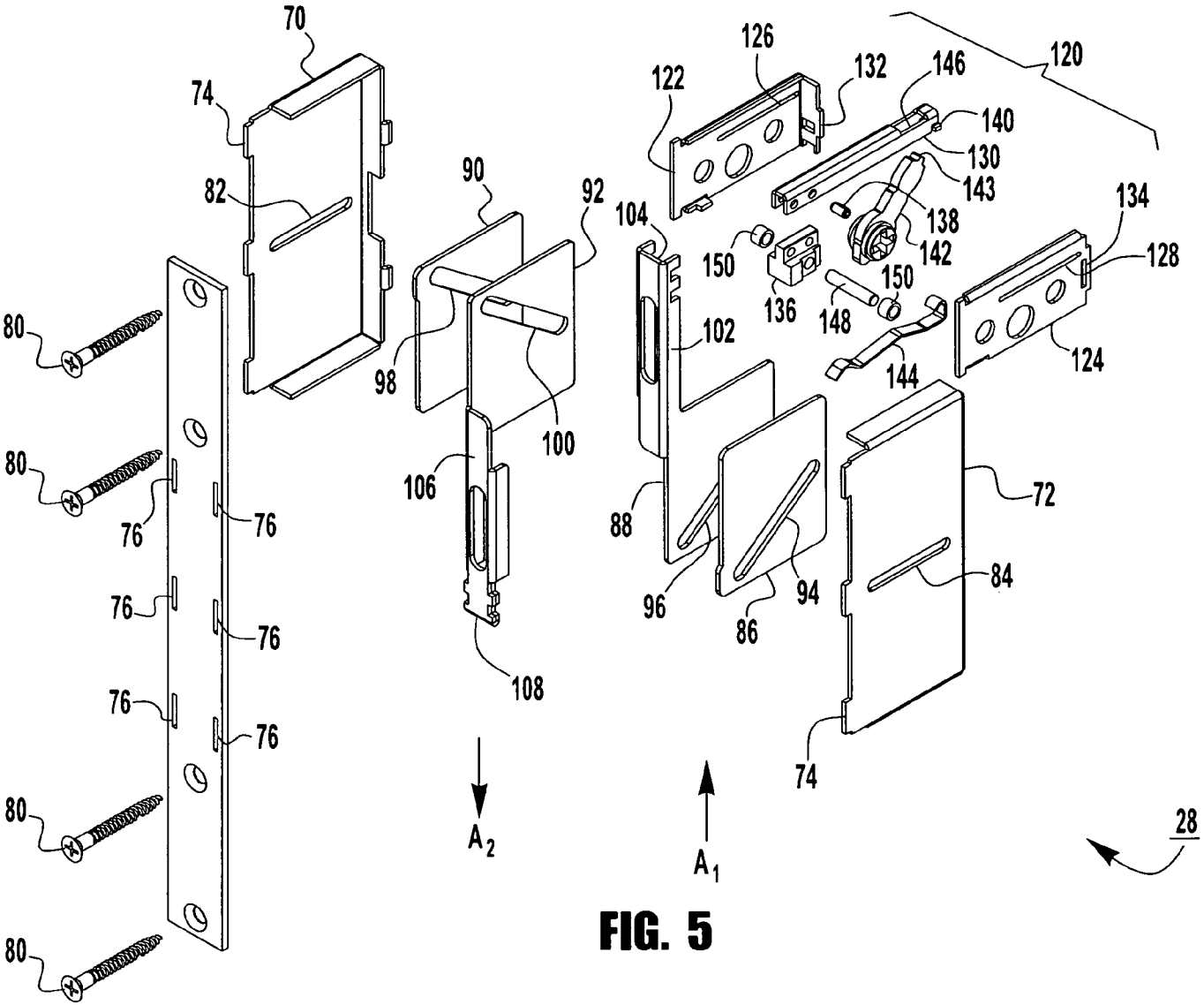
FIG. 5 is an exploded perspective view of a portion of the multipoint locking assembly of FIG. 1, showing a cam assembly.

The construction and operation of the cam assembly 28 will now be discussed in greater detail. An exploded perspective view of the cam assembly 28 is shown in FIG. 5. The cam assembly 28 includes a housing partially formed from shells 70, 72. The shells 70, 72 can be partially assembled together by hinge portions, or by any other suitable structure or method. The housing is shown assembled in FIGS. 6 and 8. Each shell has three tongues 74 that engage slots 76 in a face plate 78 to complete the housing. Four screws 80 engage the assembly 28 to the door 10 (not shown). In an assembled position, the housing includes two opposing slots 82, 84 that are perpendicular to the face plate 78 and door style 26.

Figure 9:
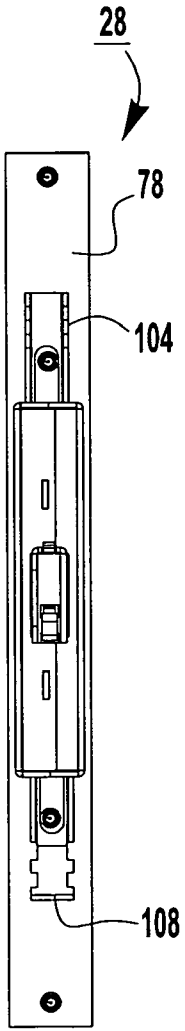
FIG. 9 is an opposing side view of FIG. 7.
Figure 10:
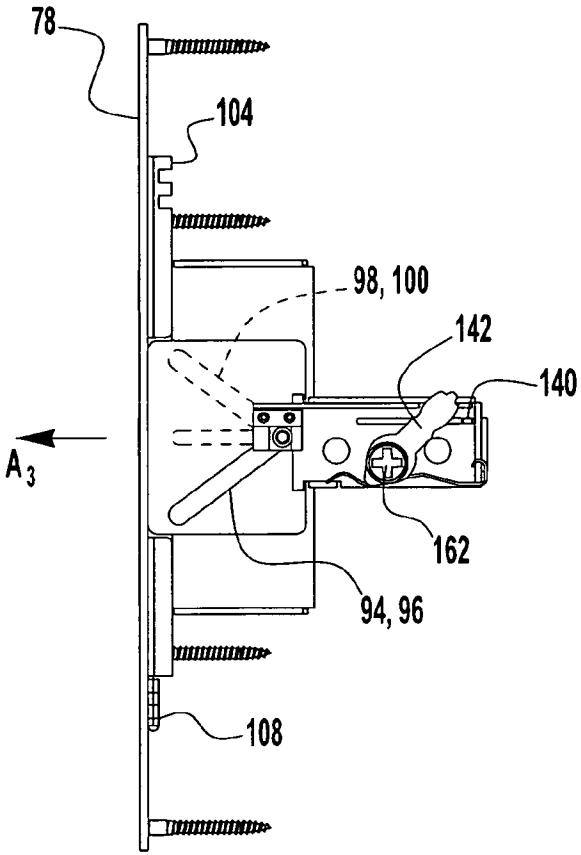
FIG. 10 is a front view, partially in section, of the cam assembly of FIG. 5, showing the extension arm in a retracted position.

Within the housing, an upper cam enforcement plate 86 and an upper cam 88 are position opposite a lower cam enforcement plate 90 and a lower cam 92. In operation of the locking assembly 24, the cams 88, 92 move within the housing in opposing directions $A_1$, $A_2$ relative to the face plate 78 and door style 26. FIG. 10 shows the orientation of the two cams 88, 92 with the cam assembly in a fully retracted position. Referring again to FIG. 5, the upper cam enforcement plate 86 and an upper cam 88 define angled slots 94, 96, while the lower cam enforcement plate 90 and a lower cam 92 define angled slots 98, 100. The upper cam 88 includes an extended link portion 102 with a distal end 104 having a toothed portion for connection to a proximal end of the upper extension actuator 30. Similarly, the lower cam 92 includes an extended link portion 106 with a distal end 108 having a toothed portion for connection to a proximal end of the latch assembly 60 link member 62. Additional views of the cam assembly 28 are also shown in FIGS. 6-9. An actuator assembly 120 is attached to a distal edge of the housing relative the face plate 78. Referring again to FIG. 5, two shells 122, 124 having opposing horizontal slots 126, 128, respectively, form a housing for the actuator assembly 120. Between the shells 122, 124, a sliding member 130 is positioned for movement in a direction perpendicular to the faceplate 78. The shells can be partially held together by a tongue 132 and slot 134 or any other suitable construction on method.

A block 136 is secured to the sliding member 130 by one or more roll pins 138 that traverse holes in each piece. The block 136 moves in the same direction as and in concert with the sliding member 130 either toward or away from the face plate 78. The movement of each piece 130, 136 is limited in part by a pair of tongues 140 that slide within either slot 126, 128 on the actuator assembly 120 housing. A lever 142 and an interface spring 144 are also positioned within actuator assembly 120. The rotatable lever is fixed at one end and includes an interface portion for securing to a lock cylinder (not shown). The distal end 143 on the lever 142 extends beyond an aperture 146 in the top surface of the sliding member 130. A roller assembly including a pin 148 and two rollers 150 is secured and positioned to the block 136. The roller ball assembly is limited in axial movement, but the rollers 150 are free to rotate toward or away from the face plate 78.

Figure 8:
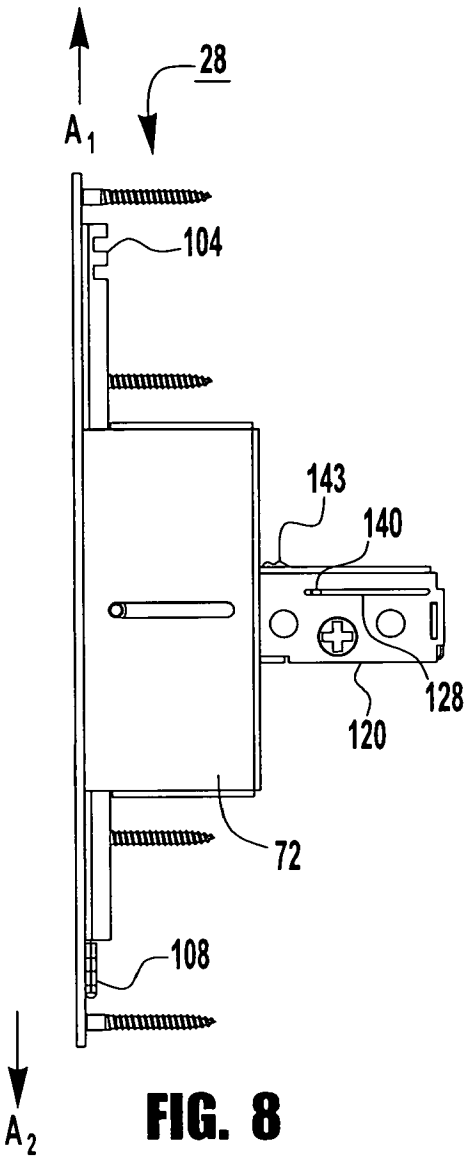
FIG. 8 is front view of the cam assembly of FIG. 5, showing the extension arm in a fully extended position.
Figure 7:
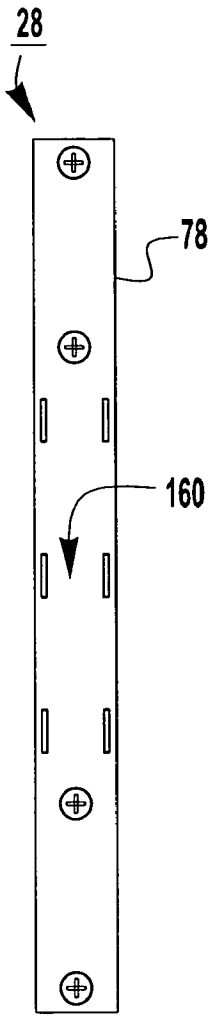
FIG. 7 is a side view of the cam assembly of FIG. 5, showing a face plate.
Figure 6:
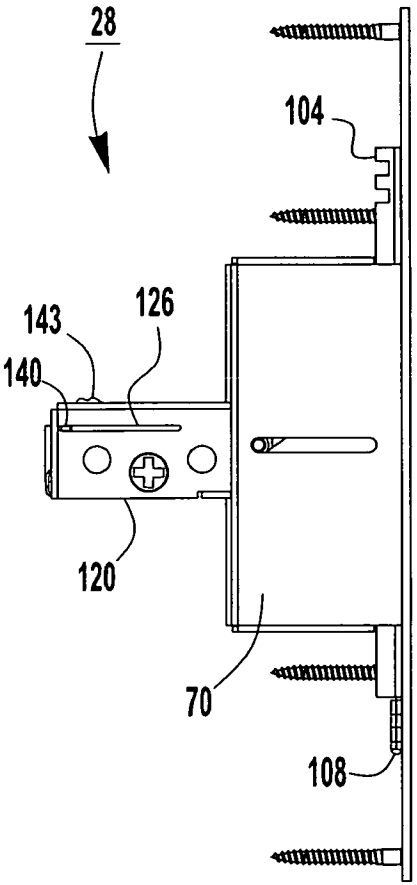
FIG. 6 is a back view of the cam assembly of FIG. 5, showing an extension arm in a retracted position.

In operation, manual turning of a cylinder (not shown) by a user engages the lever arm 142 to rotate toward the face plate 78 and linearly move the sliding member 130 toward the cams 88, 92. As a result, the pin 148 moves toward the face plate to move the upper cam 88 and lower cam 92 in opposing vertical directions $A_1$, $A_2$, respectively. FIGS. 6 and 9 show the sliding member 130 in a retracted position. The lever distal end 143 is in a rotated position away from the face plate 78. In contrast, FIG. 8 shows the sliding member 130 in a fully extended position and the lever distal end 143 fully rotated toward the face plate 78. FIG. 7 is a side view of the cam assembly 28, showing a center portion 160 of the face plate 78. The center portion is solid and does not permit travel of extending or traversing bolts, hooks or other types of locking members.

Figure 12:
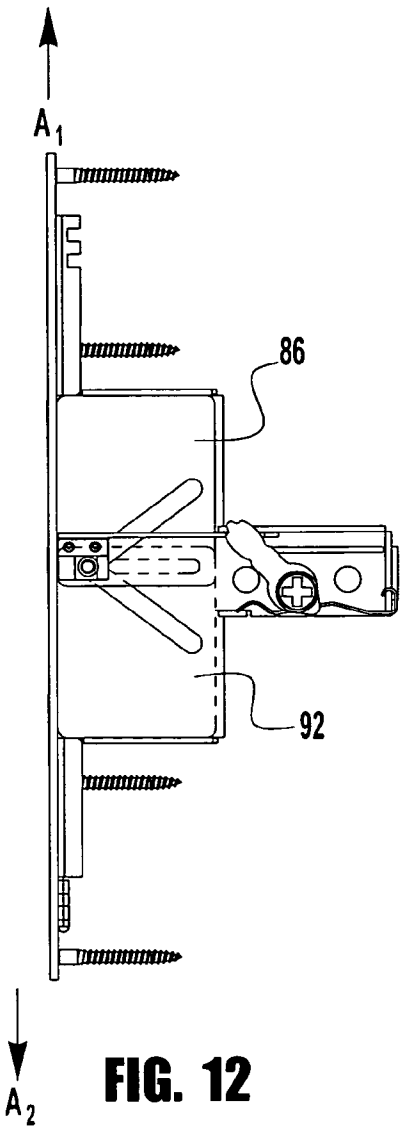
FIG. 12 is a front view, partially in section, of the cam assembly of FIG. 5, showing the extension arm in a fully extended position.
Figure 11:
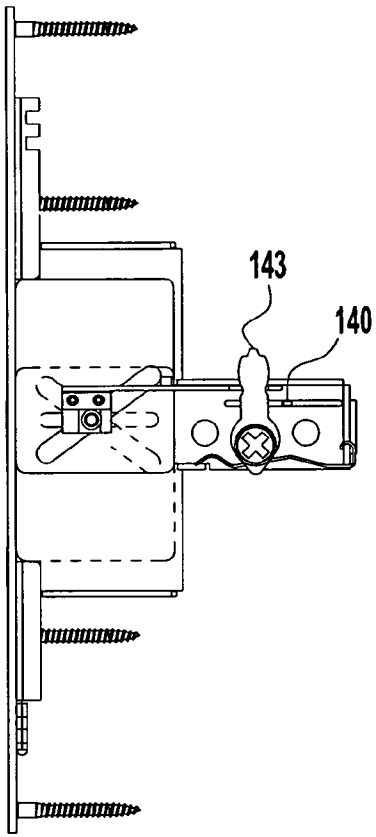
FIG. 11 is a front view, partially in section, of the cam assembly of FIG. 5, showing the extension arm in a partially extended position.

In views shown in FIGS. 10-12, the housing shell 72 and the actuator assembly shell 124 on the proximal side are not shown to further explain interaction of the various parts. FIG. 10 is a view of the cam assembly 28 showing the sliding member 130 in a fully retracted position. The upper cam and lower as shown have straight cam slots 96, 100, respectively, each angled with respect to a longitudinal axis of the sliding member 130. It should be understood that the invention can be practiced with either arcuate or straight slots in the cams 88, 92.

A tail piece of a cylinder (not shown) interfaces with the lever arm 142 via a cross-shaped cavity 162. When the cylinder is turned by a user, this in turn rotates the lever 142 counter-clockwise relative to FIG. 10 and moves the sliding member 130 in a direction $A_3$. As discussed, the sliding member 130 is fixed directly to the block 136. As a result, the sliding member 130 and block 136 act as one part, i.e., when the sliding member 130 moves toward the face plate 78, the block 136 moves. The block 136 has a pin 148 pressed through it that has two rollers 150 on it that are located on opposite sides. Each roller interfaces with a cam slot 96, 100 that is in the respective upper and lower cams. These cams 88, 92 are disposed within the housing so that their movement is limited to a direction that is perpendicular to the movement of the sliding member 130. As sliding member 130 moves in a direction $A_3$, the pin and roller 148, 150 interact with cam slot in the respective cams and the distal ends 102, 108 of the cams move out of the housing. FIG. 11 is view of the cam assembly 28 showing the lever 142 in a partially rotated position. In FIG. 12, the lever 142 is shown in the fully extended position. In this view, it is apparent that no parts on the cam assembly extend beyond the face plate in the direction $A_3$ with the sliding member in a fully extended position.

Figure 13:
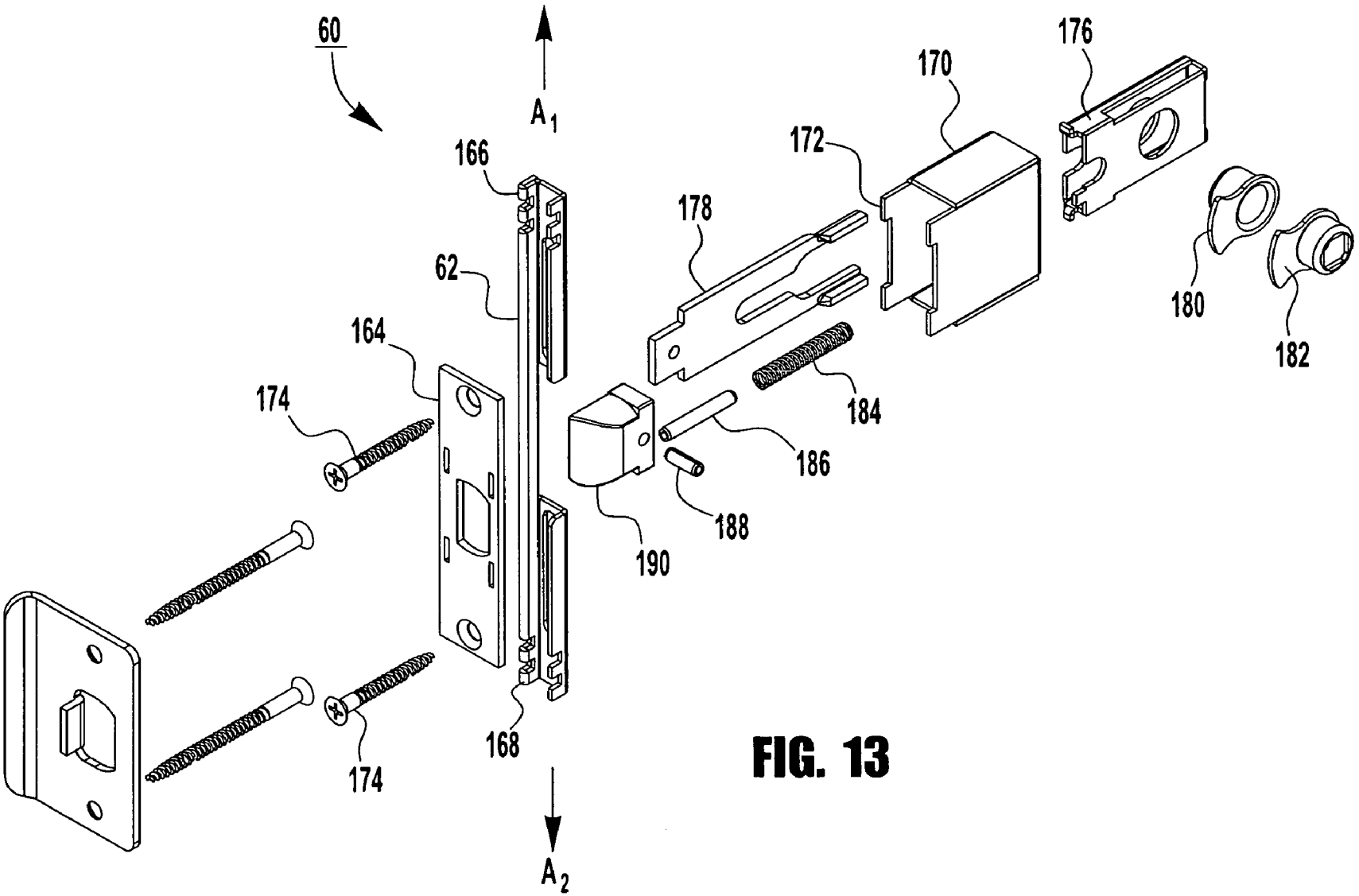
FIG. 13 an exploded perspective view of another portion of the multipoint locking assembly of FIG. 1, showing a latch assembly.
Figure 17:
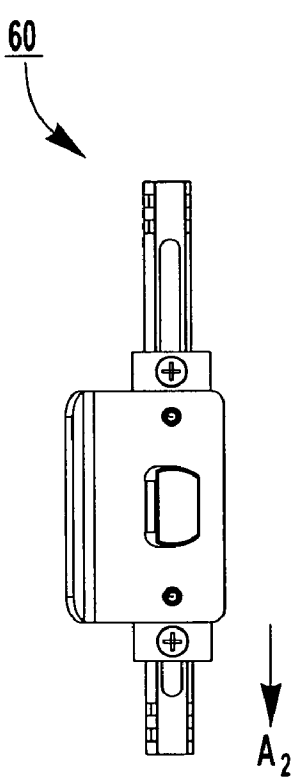
FIG. 17 is an opposing side view of FIG. 15.
Figure 16:
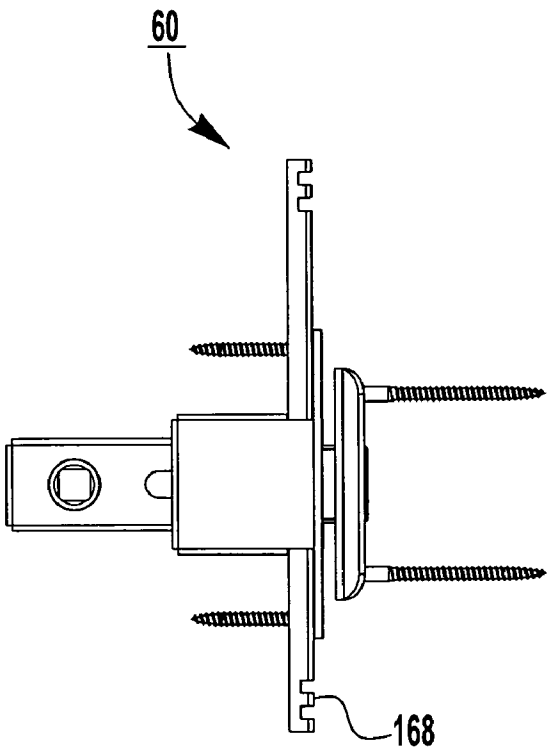
FIG. 16 is a back view of the latch assembly of FIG. 13.
Figure 15:
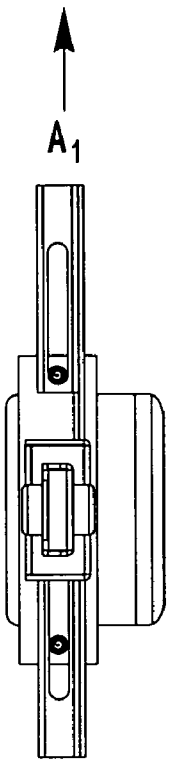
FIG. 15 is a side view of the latch assembly of FIG. 13.
Figure 14:
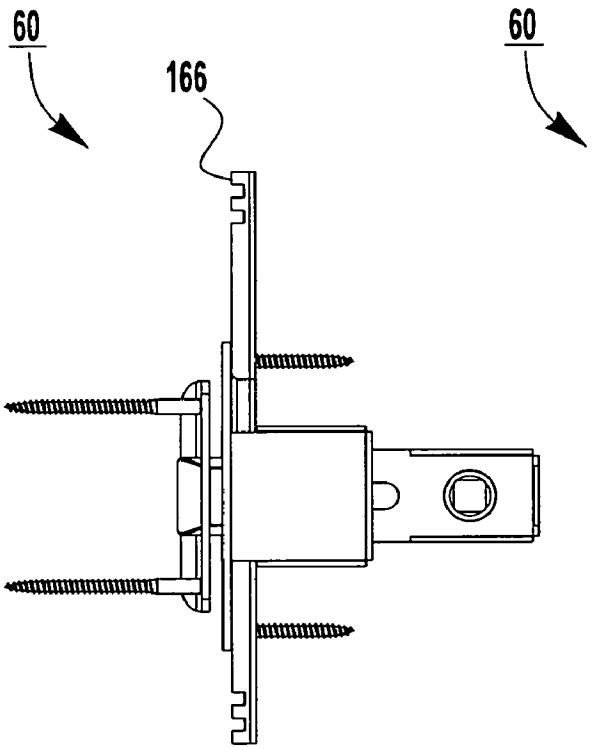
FIG. 14 is a front view of the latch assembly of FIG. 13, showing an orientation of a plunger with hardware installed in an adjacent door frame.

Referring now to FIG. 13, an exploded perspective view of another portion of the multipoint locking assembly 28 is shown. As illustrated in FIG. 2, a latch assembly 60 is disposed between the cam assembly 28 and lower extension actuator 38. A member 62 is disposed in the latch but moves freely in directions $A_1$, $A_2$ relative to the door style 26 and a latch assembly face plate 164. Movement of the latch assembly 60 by manual operation of a door handle does not effect any movement of the multipoint locking device 24. Figures are various other views of the latch assembly 60.

Referring again to FIG. 13, the latch assembly may be mounted contiguous, adjacent or a distance from the cam assembly. In an embodiment illustrated, the latch assembly 60 is mounted between the cam assembly 28 and the floor. The link member 62 includes notches 166 to engage an extending portion 108 of the lower cam 92 and notches 168 to engage the lower extension actuator 38 (see FIG. 2) that connects to a slide hook assembly 56, to be discussed in greater detail.

The latch assembly 60 includes an outer body 170 having four tongues 172 that engage slots in the face plate 164. Two screws 174 engage the assembly 60 to a door (not shown). Within the outer body 170 and an outer body extension piece 176, a plate 178 travels in a direction perpendicular to the plane of the faceplate 164. Two cams 180, 182 move plate 178 against the force of a spring 184 when a user turns a doorknob (not shown). A rod 186 may be used for stabilizing the spring 184 about a longitudinal axis. A pin 188 connects the plate 178 to a latch 190.

In operation, the spring 184 is biased to maintain the latch 190 in an extended or closed position. Manual operation of a standard door knob retracts the latch. Movement of the latch in either direction in the horizontal plane does not effect operation of the cam assembly or any of the components thereof.

Figure 18:
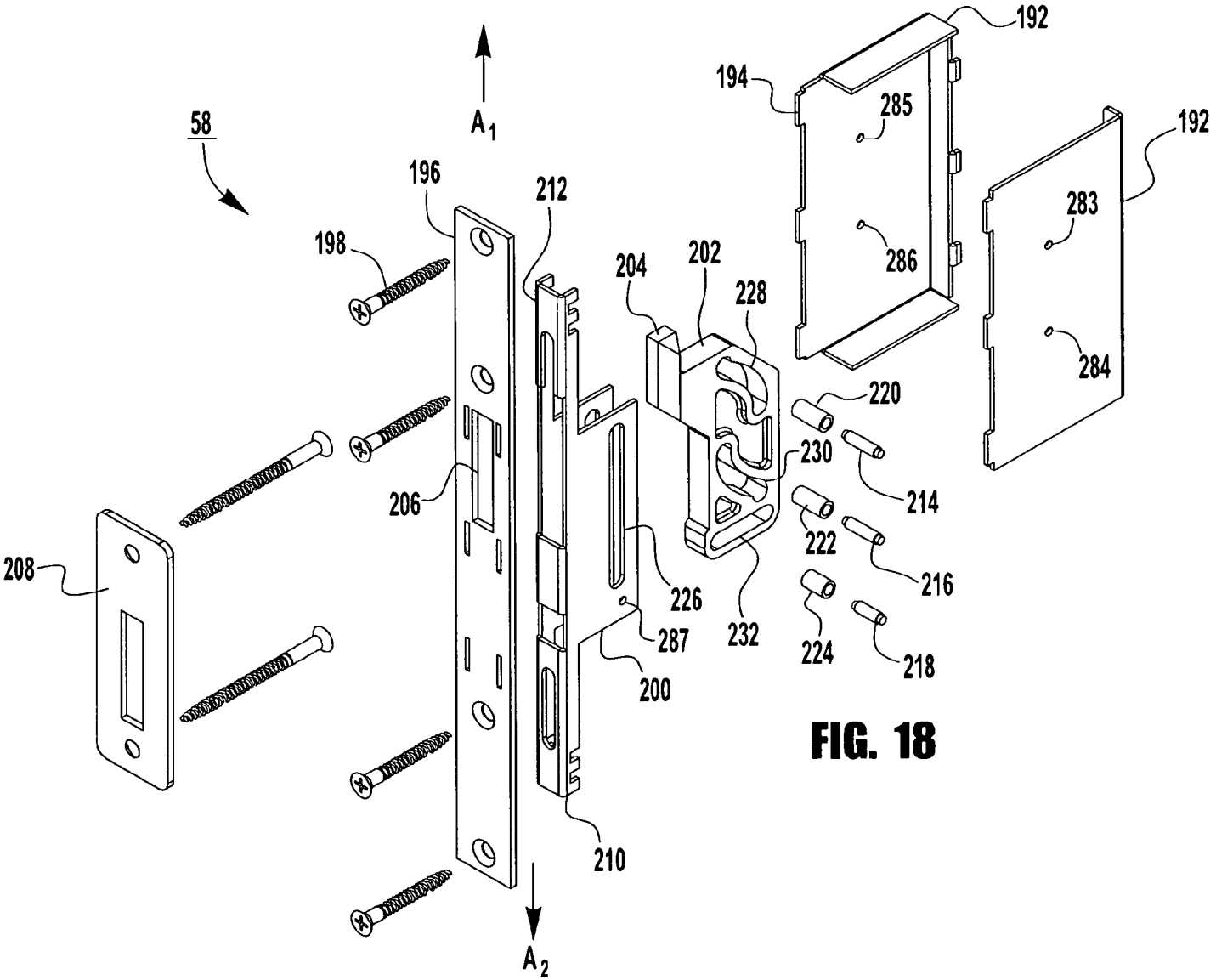
FIG. 18 an exploded perspective view of yet another portion of the multipoint locking assembly of FIG. 1, showing a slide hook assembly.

Referring now to FIG. 18, an exploded perspective view of second slide hook assembly 58 is shown. The second slide hook assembly 58 is disposed between the cam assembly 28 and upper extension actuator 34. The actuator link 44 provides a mechanical connection between the cam assembly 28 and the second slide hook assembly 58. Second slide hook assembly 58 is mounted a distance from the cam assembly. In the embodiment shown, first and second slide hook assemblies 52, 58 are mounted between the cam assembly 28 and the top of the door 10. It should be apparent that any number of slide hook assemblies, placed in a variety of locations, may be utilized in the practice of this invention.

The second slide hook assembly 58 includes an outer body 192 having six tongues 194 that engage slots in a face plate 196. Four screws 198 engage the assembly 58 to a door 10 (not shown). Within the outer body 192, a slide 200 and slide hook body 202 are positioned. The slide hook body 202 includes a bent hook portion 204 that is extendable through an aperture 206 in the face plate 196 to secure to a mounting plate 208 in the door jam. A lower portion 210 of the slide 200 includes notches to engage the actuator link 44 (not shown), which in turn engages the upper cam 88 extending portion distal end 104. Any number and type of extensions of any practical length can be used between the upper cam 88 and the slide 200. As a result, rotational movement of the lever 142 and consequential lateral movement of the sliding member 130 moves the slide 200 in a direction parallel to the plane of the face plate 196. A top portion 212 of the slide includes notches to engage the upper extension actuator 34 (not shown), which in turn engages a portion of the upper slide hook mechanism 52.

Movement of the plate 200 is translated to the slide hook body 202 by three pins 214, 216, 218 that are inserted into rollers 220, 222, 224, respectively. The pin/roller assemblies 214, 228 and 216, 222 are engaged in holes 283, 284, 285 and 286 in outer bodies 192, respectively, and pass through a vertical slot 226 in the plate 200. Pin/roller assemblies 218, 224 engage through hole 287 in plate 200. The rollers 220, 222, 224 are singularly engaged through three slots 228, 230, 232, respectively, in the slide hook body 202. As shown, two slots 228, 230 are arcuate and one slot 232 is straight. The straight slot 232 is proximal to the cam assembly 28. It should be understood that various slot patterns in the plate 200 and the slide hook body 202 and combinations thereof can be utilized in the practice of the present invention. It should also be understood by others that other constructions of the slide hook assembly are possible in the practice of this invention.

Figure 22:
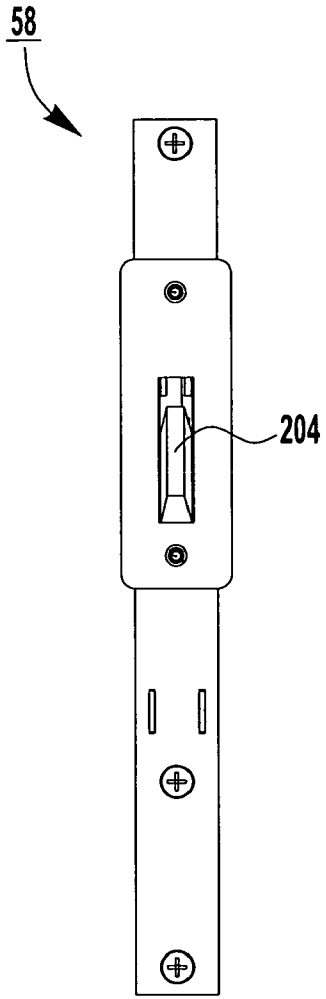
FIG. 22 is an opposing side view of FIG. 20, showing a face plate.
Figure 20:
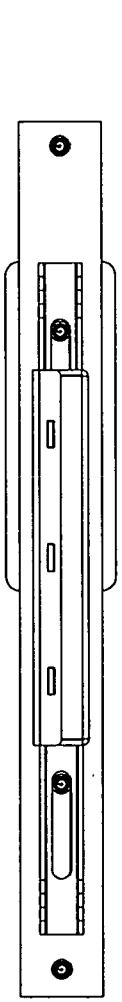
FIG. 20 is a side view of the slide hook assembly of FIG. 18.
Figure 19:
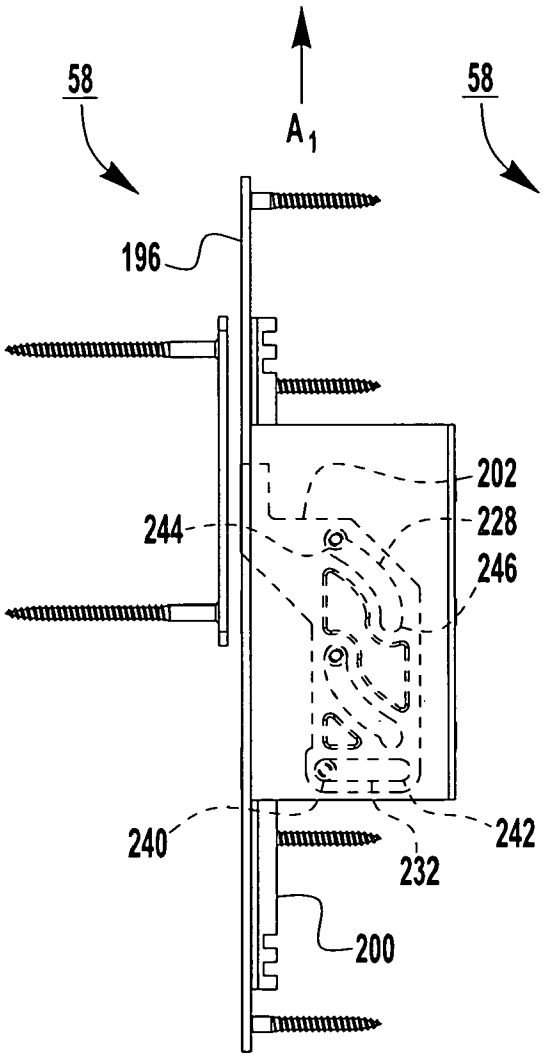
FIG. 19 is a front view, partially in section, of the slide hook assembly of FIG. 18, showing the slide hook assembly in a retracted position relative to hardware installed in an adjacent door frame.

Certain operational positions of the slide hook assembly 58 are illustrated in part in FIGS. 19-22. FIG. 19 is a front view, partially in section, showing the slide hook body 202 in a retracted position relative to hardware installable in an adjacent door frame. FIGS. 20 and 22 are opposing side views of the slide hook assembly 58 in the position shown in FIG. 18. The slide hook body 202 is shown in a fully extended position in FIG. 21.

Figure 21:
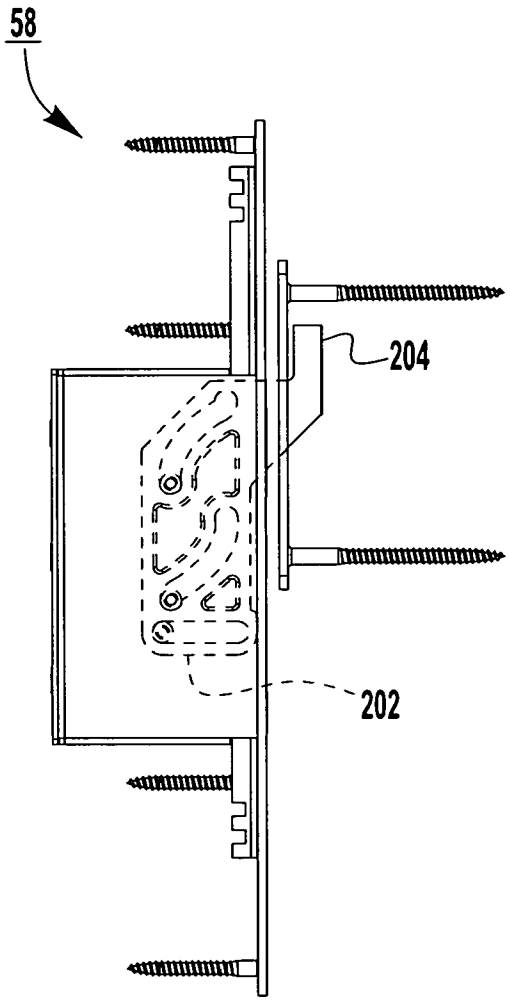
FIG. 21 is a back view of the slide hook assembly of FIG. 18, showing the slide hook assembly in an extended position relative to hardware installed in an adjacent door frame.

In operation, the upward movement of the plate 200 in the direction $A_1$ forces movement of the slide hook body 202. Movement of the slide hook body 202 will be discussed by focusing on the effects on an exemplary roller and slot combination. When the slide hook body 202 is in a retracted position as shown in FIGS. 19, 20 and 22, the roller 224 rests at end point 240 in straight slot 232. The end point 240 is at the closest point in the slot 232 to the face plate 196. As the plate 200 travels in the direction $A_1$, the roller 224 moves parallel in relation to the face plate 84 and the opposing end point 242 of the slot 232 moves towards the roller 224. The movement of the slide hook body 202 is also controlled by the two arcuate slots 228, 230. All three slots 228, 230, 232 combine to rotate the tip of the hook portion 204 in a "down and out" pattern first, then "up and back" into a locking cavity in the door jam, as shown in FIG. 21. As the cam assembly 28 movement is reversed by the user, the slide hook pattern reverses and the hook portion 204 disengages the door jam.

The complimentary roller and slot movement of an arcuate slot will now be discussed. When the slide hook body 202 is in a retracted position as shown in FIGS. 19, 20 and 22, the roller 220 rests at end point 244 in the arcuate slot 228. The end point is at the closest point in the slot 228 to the face plate 196. As the plate 200 travels in the direction $A_1$, the roller 224 remains fixed in relation to the face plate 196 and housing 192 but the opposing end point 246 of the slide hook body 202 moves towards the roller 220. As the cam assembly 28 movement is reversed by the user, the slide hook pattern reverses and the hook portion 204 disengages the door jam. The roller 222 is also fixed relative to the face plate 196 and housing 192.

Figure 23:
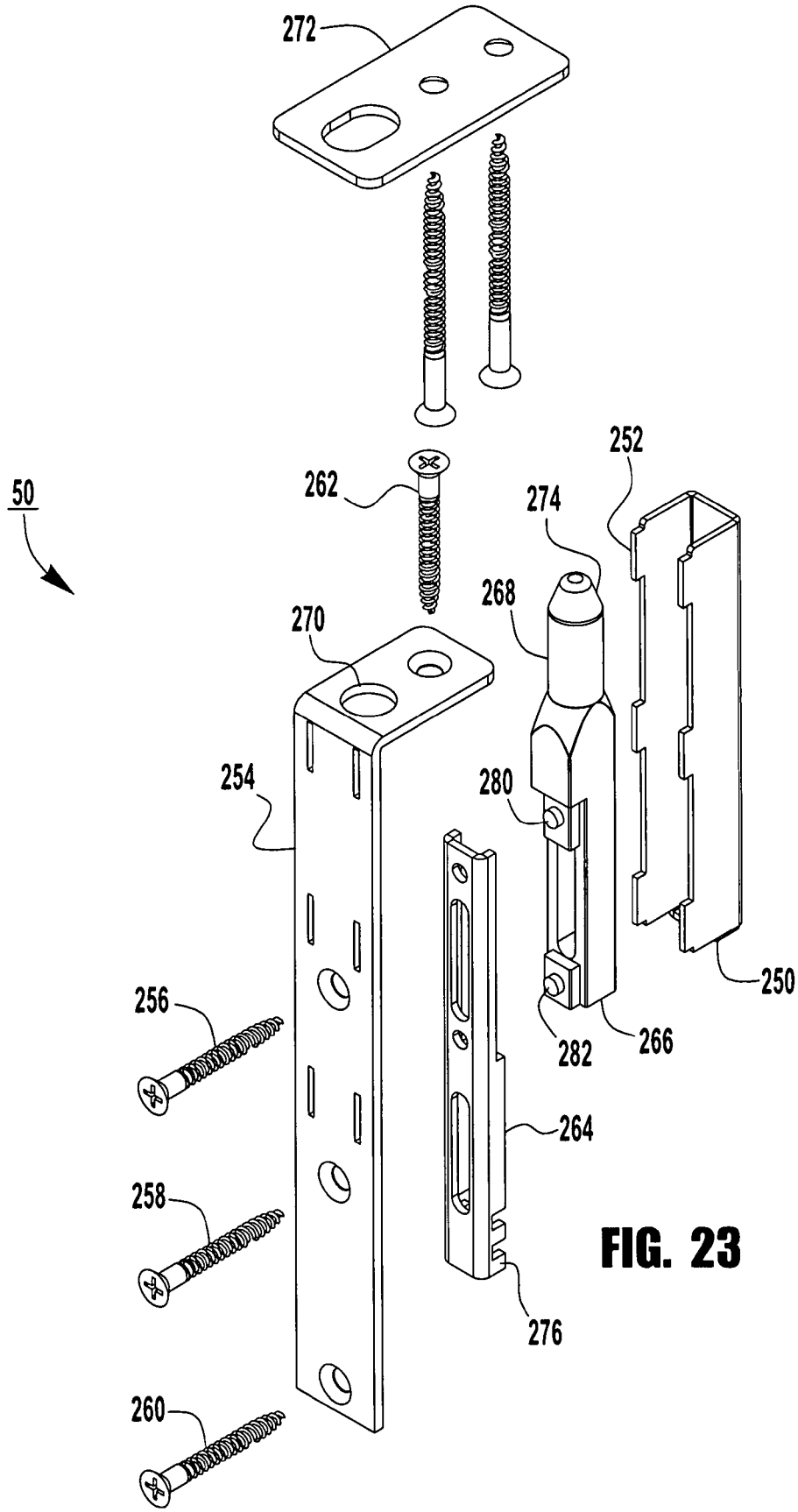
FIG. 23 an exploded perspective view of yet another portion of the multipoint locking assembly of FIG. 1, showing a shoot bolt assembly.

The multipoint locking assembly 28 illustrated in FIG. 3 includes two shoot bolt assemblies 50, 54. An exemplary shoot bolt is shown in an exploded view in FIG. 23. The shoot bolt assembly is mounted a distance from the cam assembly 28. In the embodiment shown, upper shoot bolt assembly 50 is mounted above the cam assembly 28 at a top corner of the door 10. As shown in FIG. 3, a second lower shoot bolt assembly 54 is mounted below the cam assembly 28 at a bottom corner of the door 10. This invention may be practice with either, both or neither shoot bolt assemblies installed at either, both or neither location.

The shoot bolt assembly 50 includes an outer body 250 having six tongues 252 that engage slots in a face plate 254. The L-shaped face plate is designed for mounting in the corner of the door or door style 26. Three screws 256, 258, 260 engage the assembly 50 to a door 10 through the long leg of the face plate 254. A single screw 262 engages the assembly 50 to the door through the short leg of the face plate 254. Any suitable mounting technique or combination of hardware can be used to mount this assembly, or any other assembly, to the door or door style in the practice of this invention.

Within the outer body 250, a slide 264 and shoot bolt 266 are positioned. The shoot bolt 266 includes an end portion 268 that extends through an aperture 270 in the short leg of the face place 254 to secure to extend through mounting hardware 272 located in the overhead horizontal door frame (not shown). A distal tip 274 of the end portion may be tampered or conical to ease insertion. A bottom portion 276 of the slide 264 includes notches to engage a actuator link 42, which in turn engages an upper extending portion of the upper slide hook assembly 52. Any number of extensions of any practical length can be used between the upper slide hook assembly 52 and the slide 108. Plate 264 moves in a direction parallel to the plane of the long leg of the faceplate 104. Movement of the slide 264 is translated to the shoot bolt 266 by tabs 280, 282 that are fixed to the bolt 266. Additional views of the shoot bolt assembly 100 are shown in FIGS. 19-22. It should be understood by others that other constructions of the shoot bolt assembly are possible in the practice of this invention.

Figure 27:
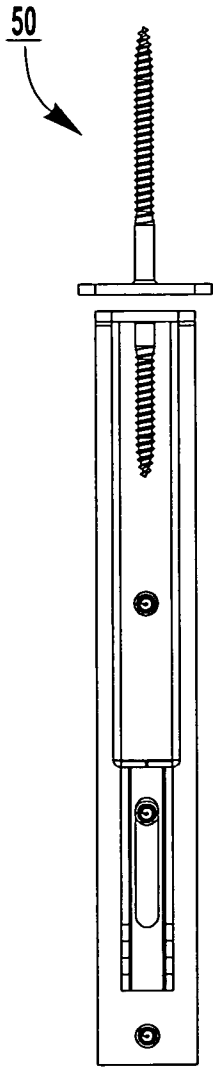
FIG. 27 is an opposing side view of FIG. 25.
Figure 26:
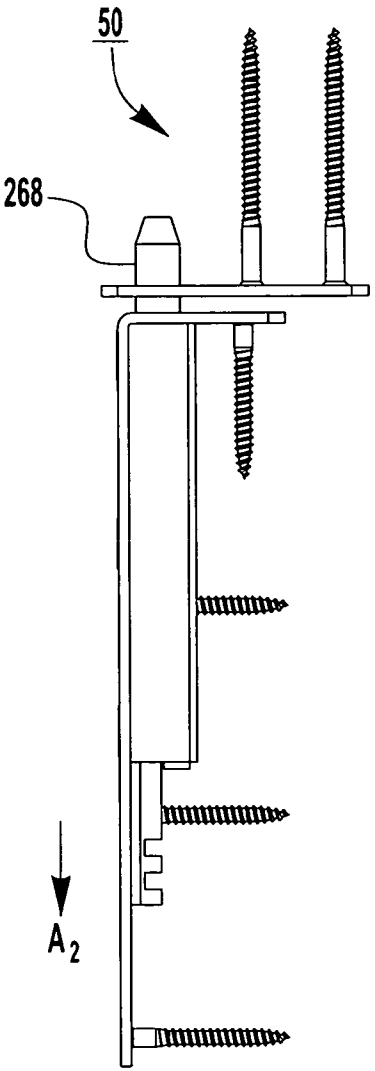
FIG. 26 is a front view of the shoot bolt assembly of FIG. 23, showing the shoot bolt assembly in an extended position relative to hardware installed in an adjacent door frame.
Figure 25:
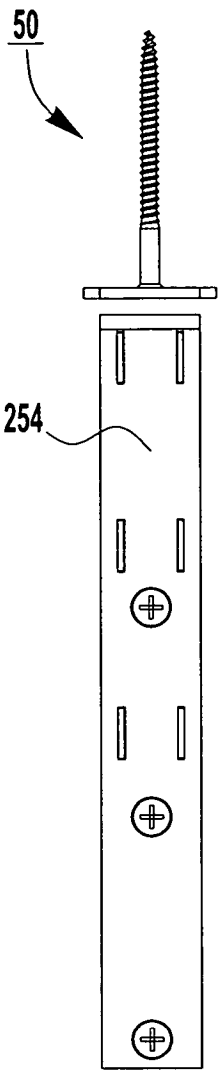
FIG. 25 is a side view of the shoot bolt assembly of FIG. 23, showing a face plate.
Figure 24:
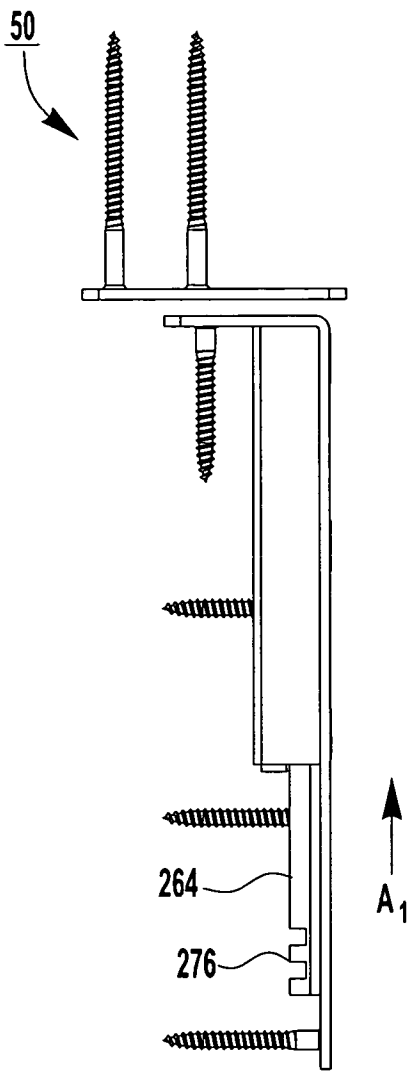
FIG. 24 is a back view of the shoot bolt assembly of FIG. 23, showing the shoot bolt assembly in a retracted position relative to hardware installed in an adjacent door frame.

Certain operational positions of the shoot bolt assembly 50 are illustrated in part in FIGS. 24-27. FIG. 24 shows the shoot bolt 266 hidden in a retracted position relative to hardware installable in an adjacent door frame. FIGS. 25 and 27 are opposing side views of the shoot bolt assembly 50 in the position shown in FIG. 24. The end portion 268 of the shoot bolt 266 is shown in a fully extended position in FIG. 26.

In operation, the upward movement of the slide 108 in the direction $A_1$ forces movement of the shoot bolt 266 into a cavity in top of door frame through an aperture 270 in top of face plate 254. The end portion 274 is conical to allow for ease of alignment. In motion, the shoot bolt 266 does not rotate or pivot. As the cam assembly 28 movement is reversed by the user, the shoot bolt pattern is reversed and the bolt 266 disengages the door frame.

While several embodiments of the invention has been illustrated and described in considerable detail, the present invention is not to be considered limited to the precise constructions disclosed. Various adaptations, modifications and uses of the invention may occur to those skilled in the arts to which the invention relates. It is the intention to cover all such adaptations, modifications and uses falling within the scope or spirit of the claims filed herewith.

What is claimed is:

1. A locking assembly comprising:

an elongated base for mounting to a door;

a cam assembly mounted to said elongated base including a housing, a lever, and a sliding member having a first end movably connected to said lever and movable in a direction perpendicular to a longitudinal axis of said elongated base by rotation of said lever;

an extension actuator having a proximal end movably connected to a second end of said sliding member; and a slide hook assembly mounted to said elongated base and movable between an unlocked position and a locked position and having a hook movable in a direction less than 180 degrees relative to the longitudinal axis of said elongated base, said slide hook assembly comprising a face plate, a member forming a slide channel and defining two opposing member slots parallel to the longitudinal axis of said elongated base, a hook body at least partially disposed within said slide channel and defining at least two hook body slots, and at least two pins, each of said at least two pins at least partially transversing one of said at least two hook body slots and each of said two opposing member slots;

wherein said sliding member is movable by rotation of said lever to transfer said lock mechanism to said locked position;

further wherein said second end of said sliding member extends to a position within said housing upon full rotation of said lever.

2. The locking assembly of claim 1 wherein said hook body defines three hook body slots, wherein one slot is straight and two slots are arcuate.

3. The locking assembly of claim 2 wherein said straight slot is dispose proximal to the cam assembly relative to said two arcuate slots.

4. The locking assembly of claim 1 wherein one of said at least two pins is fixed with said slide hook assembly relative to said elongated base.

5. The locking assembly of claim 1 wherein movement between said unlocked position and said locked position forces movement of said hook body relative to said at least two pins, such that in said unlocked position one of said at least two pins rests in a proximal end of one of said at least two hook body slots relative to said face plate and in said locked position one of said at least two pins rests in a distal end of one of said at least two hook body slots to relative to said face plate.

6. The locking assembly of claim 1 wherein said elongated base is a door style defining a channel.

7. The locking assembly of claim 1 wherein said sliding member defines an aperture adjacent said first end sized to accommodate a non-mounted end of said lever.

8. The locking assembly of claim 1 wherein said sliding member defines an aperture though which said lever extends throughout a full range of motion.

9. A door locking assembly comprising:

a) an elongated base for mounting to a door;

b) a cam assembly mounted to said elongated base including a lever and a sliding member having a first end slidably connected to said lever and movable in a direction perpendicular to a longitudinal axis of said elongated base by rotation of said lever;

c) an extension actuator having a proximal end movably connected to a second end of said sliding member; and d) a slide hook mechanism mounted to said elongated base and movable between an unlocked position and a locked position, wherein said extension actuator is movable by rotation of said lever to transfer said slide hook mechanism to said locked position, said slide hook mechanism including:

i. a face plate;

ii. a member forming a slide channel and defining two opposing slots parallel to the longitudinal axis of said elongated base;

iii. a hook body at least partially disposed within said slide channel and defining three hook body slots, wherein one slot is straight and two slots are arcuate; and iv. at least two pins, each of said at least two pins at least partially transversing one of said three hook body slots and each of said two opposing slots;

e) wherein said face plate is constructed of essentially solid material to prohibit traversing bolts.

10. The door locking assembly of claim 9 wherein said slide hook mechanism hook body is movable in a direction less than 180 degrees relative to the longitudinal axis of said elongated base.

11. The door locking assembly of claim 9 wherein said straight slot is dispose proximal to the cam assembly relative to said two arcuate slots.

12. The door locking assembly of claim 9 wherein one of said at least two pins are fixed with said slide hook mechanism relative to said elongated base.

13. The door locking assembly of claim 9 wherein movement between said unlocked position and said locked position forces movement of said hook body relative to said at least two pins, such that in said unlocked position one of said at least two pins rests in a proximal end of one of said at least two hook body slots relative to said face plate and in said locked position one of said at least two pins rests in a distal end of one of said at least two hook body slots to relative to said face plate.

14. The door locking assembly of claim 9 wherein said sliding member defines an aperture through which said lever extends throughout a full range of motion.

15. A door having a top, front and bottom edge, said door comprising:

a cylinder lock interface mounted to said door;

a door style mounted to said front edge;

a cam assembly mounted to said door style including a housing, a lever rotatable at one end by rotation of said cylinder lock interface, and a sliding member having a first end secured to said lever and movable in a direction towards said front edge by rotation of said cylinder lock interface;

an extension actuator having a proximal end movably connected to a second end of said sliding member; and a slide hook mechanism mounted to said door style at a location between said top edge and said cam assembly and having a hook body movably connected to a distal end of said extension actuator and movable from an unlocked position to a locked position extending beyond said front edge by rotation of said cylinder lock interface;

wherein a second end of said sliding member remains within said housing upon full rotation of said lever;

further wherein said hook body defines three hook body slots, wherein one slot is straight and two slots are arcuate.

16. The door of claim 15 wherein said hook body is movable in a direction less than 180 degrees relative to the longitudinal axis of said door style and away from said cam assembly and said door style.

17. The door of claim 15 wherein said slide hook assembly comprises:

a) a face plate;

b) a member forming a slide channel and defining two opposing slots parallel to the longitudinal axis of said door style;

c) a hook body at least partially disposed with said slide channel and defining at least two hook body slots; and d) at least two pins, each of said at least two pins at least partially transversing one of said at least two hook body slots and each of said two opposing slots.

18. The door of claim 15 wherein said straight slot is dispose proximal to the cam assembly relative to said two arcuate slots.

19. The door of claim 17 wherein one of said at least two pins are fixed with said slide hook assembly relative to said elongated base.

20. The door of claim 17 wherein movement between said unlocked position and said locked position forces movement of said hook body relative to said at least two pins, such that in said unlocked position one of said at least two pins rests in a proximal end of one of said at least two hook body slots relative to said face plate and in said locked position one of said at least two pins rests in a distal end of one of said at least two hook body slots to relative to said face plate.

21. The door of claim 15 wherein said door style defines a channel.

22. The door of claim 15 wherein said sliding member defines an aperture adjacent said first end sized to accommodate a non-mounted end of said lever.

23. The door of claim 15 wherein said sliding member defines an aperture through which said lever extends throughout a full range of motion.

24. The door of claim 17 wherein said face plate is constructed of essentially solid material to prohibit transversing bolts.

25. A door having a top, front and bottom edge, said door comprising:

a cylinder lock interface mounted to said door;

a door style mounted to said front edge;

a cam assembly mounted to said door style including a housing, a lever rotatable at one end by rotation of said cylinder lock interface, and a sliding member having a first end secured to said lever and movable in a direction towards said front edge by rotation of said cylinder lock interface;

an extension actuator having a proximal end movably connected to a second end of said sliding member;

a slide hook mechanism mounted to said door style at a location between said top edge and said cam assembly and having a hook body movably connected to a distal end of said extension actuator and movable from an unlocked position to a locked position extending beyond said front edge by rotation of said cylinder lock interface;

a second extension actuator having a proximal end movably connected to said second end of said sliding member;

a second slide hook mechanism mounted to said door style at a location between one of said top edge and said bottom edge and said cam assembly and having a second hook body movably connected to a distal end of said second extension actuator and movable from an unlocked position to a locked position extending beyond said front edge by rotation of said cylinder lock interface;

a third extension actuator having a proximal end movably connected to said first slide mechanism; and a shoot bolt mechanism mounted to said door style at said location and having a shoot hook and in mechanical communication with a distal end of said third extension actuator and movable from an unlocked position to a locked position extending beyond said top edge by rotation of said cylinder lock interface;

wherein a second end of said sliding member remains within said housing upon full rotation of said lever.

26. A locking assembly comprising:

a) a door style;

b) a cam assembly mounted to said door style including a rotatable lever fixed at one end, and a sliding member having a first end movable by said lever in a direction perpendicular to said door style;

c) an extension actuator having a proximal end movably connected to a second end of said extension arm; and d) a slide hook mechanism movably connected to a distal end of said extension actuator and mounted to said elongated base, said mechanism including:

i. a face plate;

ii. a member forming a slide channel and defining two opposing slots parallel to said door style;

iii. a hook member at least partially disposed within said slide channel and defining two arcuate slots and one straight slot, wherein said one straight slot is proximal to said cam assembly relative to said two arcuate slots; and iv. three pins fixed with respect to said door style, each of said three pins at least partially traversing one of said three slots and each of said two opposing slots.

27. The locking assembly if claim 26 wherein said face plate is constructed of essentially solid material to prohibit transversing bolts in either direction.

* * * * *